United States Patent [19]

Kaminski

[11] Patent Number: 4,865,506

[45] Date of Patent: Sep. 12, 1989

[54] APPARATUS FOR REFORMING AN END SHELL

[75] Inventor: Elton G. Kaminski, Sidney, Ohio

[73] Assignee: Stolle Corporation, Sidney, Ohio

[21] Appl. No.: 88,701

[22] Filed: Aug. 24, 1987

[51] Int. Cl.[4] ..... S21D 51/44

[52] U.S. Cl. ..... 413/56; 413/8; 413/62; 72/348

[58] Field of Search ..... 413/8, 56, 62; 72/347, 72/348, 350, 351

[56] References Cited

U.S. PATENT DOCUMENTS

| | | | |
|---|---|---|---|
| 3,359,935 | 12/1967 | Rosbotton | 413/62 |
| 4,031,837 | 6/1977 | Jordan | 413/8 |
| 4,109,599 | 8/1978 | Schultz . | |
| 4,588,066 | 5/1986 | Kaminski | 413/8 |
| 4,704,887 | 11/1987 | Bachman et al. | 413/62 |
| 4,716,755 | 1/1988 | Bulso, Jr. et al. | 413/56 |

FOREIGN PATENT DOCUMENTS

| | | | |
|---|---|---|---|
| 522547 | 3/1956 | Canada | 72/347 |

*Primary Examiner*—Frederick R. Schmidt
*Assistant Examiner*—Robert Showalter
*Attorney, Agent, or Firm*—Frost & Jacobs

[57] ABSTRACT

An apparatus for reforming an end shell includes a stationary tooling assembly having a reform punch for engaging an interior surface of the central wall portion of the end shell. A reciprocating tooling assembly includes spring-loaded pressure pad complimentary to the reform punch for engagin the exterior surface of the central wall portion. A reform ring, mounted circumferentially about the pressure pad, includes an annular nose for fully engaging and supporting the exterior surface of the frustoconical wall portion of the end shell. At the bottom of the reforming stroke, the central wall portion is simultaneously supported by the reform punch and the pressure pad.

1 Claim, 3 Drawing Sheets

APPARATUS FOR REFORMING AN END SHELL

BACKGROUND OF THE INVENTION

1. Field of the Invention

The present invention relates generally to a tooling assembly for reforming an end shell, and in particular, is concerned with a tooling assembly which reforms an end shell to provide a reinforcing channel around a central wall portion of an end shell.

2. Description of the Related Art

It is well known that a conventional can end may have its pressure resistance increased by increasing the depth of an annular groove with respect to the end's central panel and maintaining a tight radius of curvature in the annular groove.

In particular, U.S. Pat. No. 4,109,599 discloses a method of forming a pressure resistant end shell. An upper tool includes an inside supporting surface which engages against a frustoconical wall portion of the end shell. The central wall portion of the end shell is supported by a lower tool. As the upper and lower tools are moved toward each other, an annular groove is formed around the central wall portion. The upper tool does not engage the central wall portion. Thus, the reforming is performed without support on both sides of the central wall portion. Without such support, the radius of the annular groove may vary. If the radius of the annular groove is not maintained, the performance of the end shell is jeopardized. Furthermore, without such support, the angularity of the frustoconical wall portion may vary and become unacceptable.

Consequently, a need exists for improvements in tooling for reforming an end shell. It is desirable that such improvements provide a reliable assembly for forming a pressure-resistance end shell while maintaining critical parameters such as central wall radius and frustoconical wall angularity.

SUMMARY OF THE INVENTION

The present invention includes a tooling assembly for reforming an end shell. The tooling assembly receives an end shell and provides a one-step operation for forming an annular groove around the central wall portion for increasing the pressure resistance of the end shell. The present tooling supports the central wall portion on both surfaces, and maintains the annular groove radius and angularity of the frustoconical wall portion.

In a preferred embodiment, the present reforming apparatus includes a stationary tooling assembly having a reform punch for engaging an interior surface of the central wall portion of an end shell. A reciprocating tooling assembly includes spring-loaded pressure pad complimentary to the reform punch for engaging the exterior surface of the central wall portion. A reform ring, mounted circumferentially about the pressure pad, includes an annular nose for fully engaging and supporting the exterior surface of the frustoconical wall portion of the end shell. At the bottom of the reforming stroke, the central wall portion is simultaneously supported by the reform punch and the pressure pad.

DETAILED DESCRIPTION OF THE PREFERRED EMBODIMENT

Figure 1:
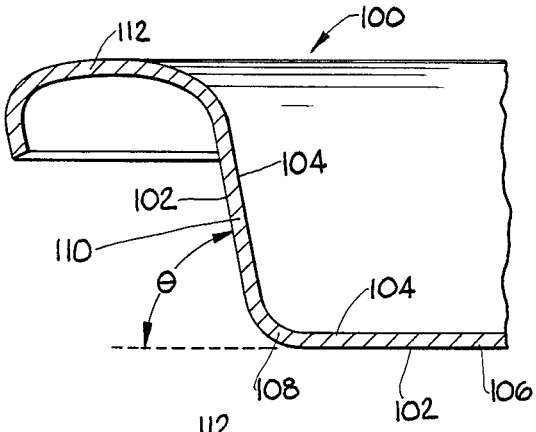
FIG. 1 is a partial, enlarged sectional view of a conventional end shell.

A typical sheet metal end shell 100 is partially illustrated in FIG. 1. The end shell 100 has interior and exterior surfaces 102 and 104, respectively, with respect to the interior and exterior of a container (not illustrated) when the end shell 100 is secured thereon. The end shell 100 includes a substantially planar central wall portion 106 and a first curved portion 108 around the periphery of the central wall portion 106, connecting the central wall portion 106 with an integral frustoconical wall portion or chuckwall 110. Frustoconical wall portion 110 projects upwardly and outwardly with respect to the exterior surface 104 of the central wall portion 106 at an angle of from 75° to 90°, and preferably from 77° to 90°. A peripheral flange 112 projects radially outwardly from and is integral with the outer edge of wall portion 110.

Figure 2:
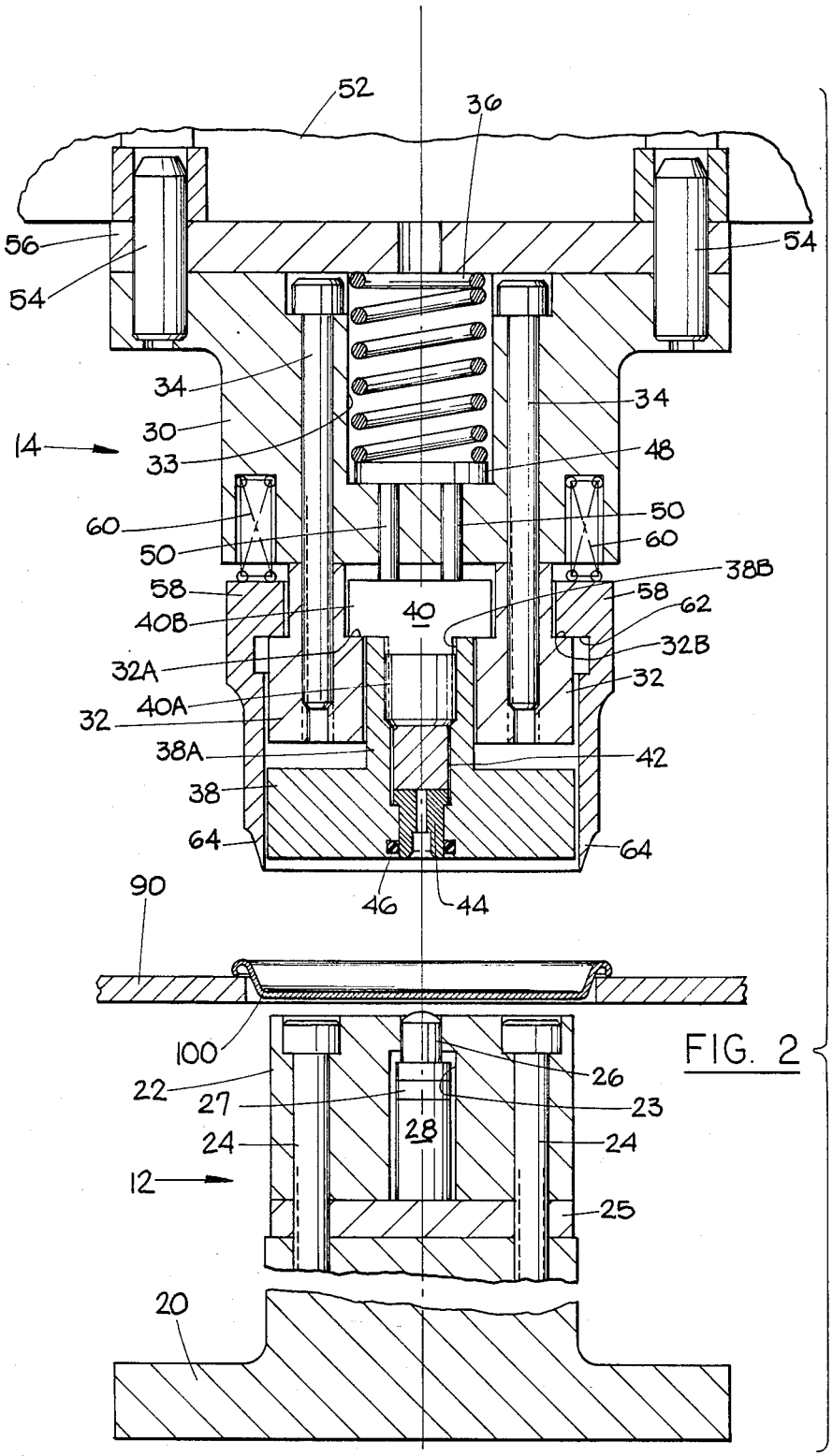
FIG. 2 is a sectional view of the present tooling assembly illustrated in the open position.
Figure 3:
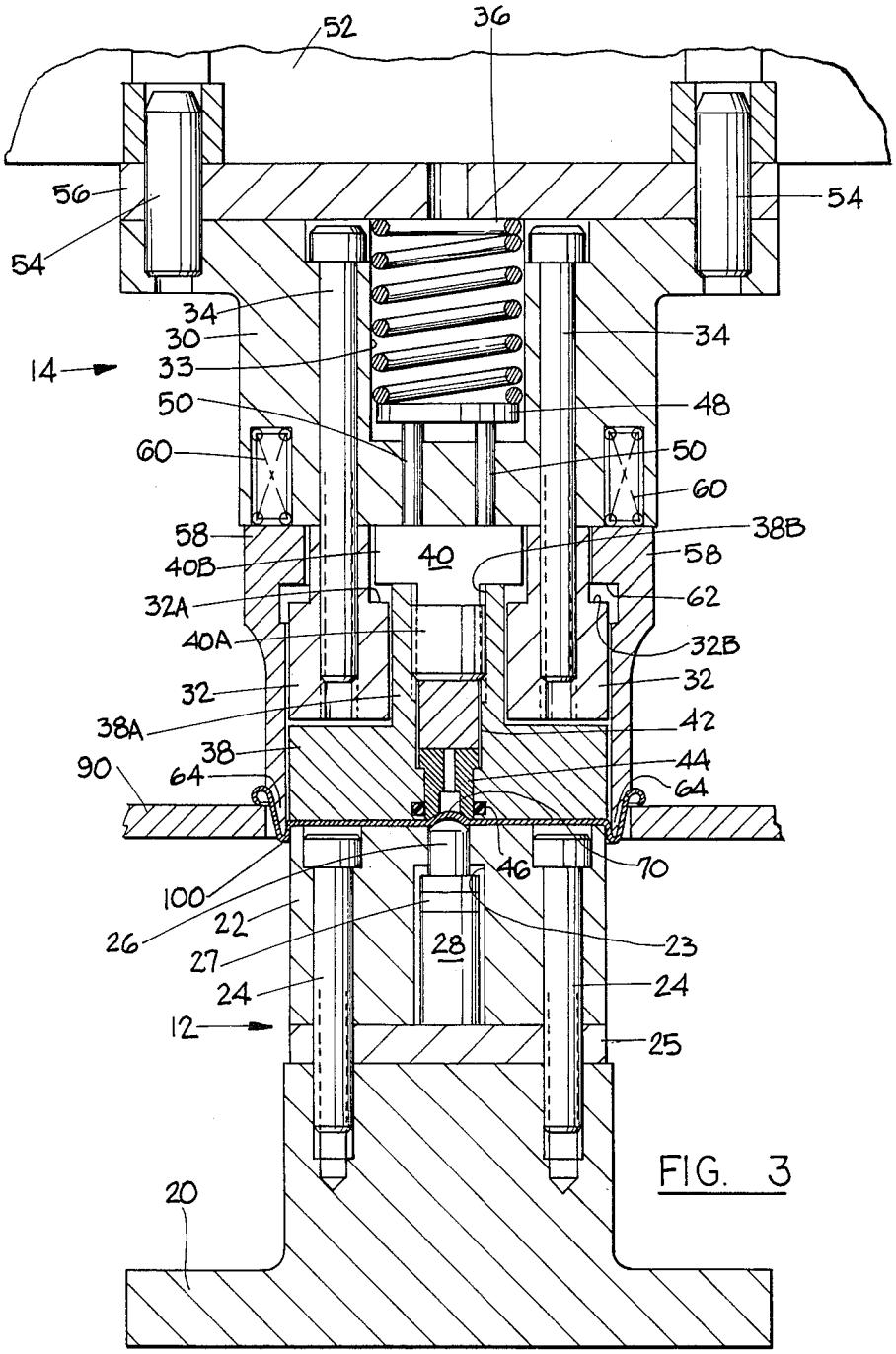
FIG. 3 is a view similar to FIG. 1 wherein the tooling assembly has been closed to reform an end shell.

A preferred embodiment of the present apparatus, indicated generally at 10, is illustrated in FIGS. 2 and 3. The apparatus 10 includes a stationary, lower tool assembly 12 and a reciprocating, upper tool assembly 14. An article transfer belt 90 includes openings for receiving end shells 100.

The lower tool assembly 12 includes a tool base 20 and a reform punch 22. Fasteners 24 secure the reform punch 22 to the base 20. A spacer 25 can be inserted between the reform punch 22 and base 20 to adjust the height of the reform punch 22. Other conventional fasteners and systems can be utilized to secure the reform punch 22 and adjust its height.

As described below, a bubble punch 26 can be provided in an accommodating, central opening 23 in the reform punch 22. A spacer 27 and a support 28 are also provided to support the bubble punch 26 on the tool base 20. The use of the bubble punch 26 is described below.

The upper tool assembly 14 includes a support 30 and a support ring 32. Fasteners 34 secure the support ring 32 to the support 30. Spring 36 is received in an accommodating, central opening 33 provided in the support 30 opposite support ring 32.

A pressure pad 38, complementary to reform punch 22 is supported by the support ring 32 by a T-shaped post 40. Stem portion 40A of post 40 is threaded into a complementary opening 38B in a stem portion 38A of pressure pad 38. Head portion 40B of post 40 extends beyond stem portion 38A and rests on an inner ledge 32A of support ring 32 surrounding stem portion 38A, as illustrated in FIG. 2. A spacer 42 and a bubble die 44 can be provided in the pressure pad opening 38B to complement bubble punch 26. An O-ring 46 is provided about the lower portion of bubble die 44.

A plate 48 is positioned in lower portion of opening 33 of support 30. Pins 50 are slidably inserted in accommodating openings in support 30. The lower ends of pins 50 are in contact with the upper surface of head portion 40B and the upper ends of pins 50 are in contact with the lower surface of plate 48.

Support 30 is secured to a reciprocating member 52 by fasteners 54. A spacer plate 56 can be inserted between support 30 and member 52 as needed. Reciprocating member 52 can be actuated by any conventional means, e.g. a cylinder, and can operate as an element of a conventional press ram (not illustrated).

A reform ring 58 is fitted about the support ring 32 and biased away from support 30 by springs 60. An inner flange 62 of reform ring 58 is supported by an outer ledge 32B when the upper tool assembly 14 is retracted from the lower tool assembly 12 as described below. The lower portion of reform ring 58 terminates in a annular nose 64 which is described in detail below.

In operation, the apparatus 10 is "open" when the upper tooling assembly 14 is retracted away from the lower tooling assembly 12. When the apparatus 10 is in the open position, the transfer belt 90 delivers an end shell 100 to the reform punch 22. The reciprocating member 52 is moved downwardly so that the upper tooling assembly 14 moves toward the end shell 100.

Figure 4:
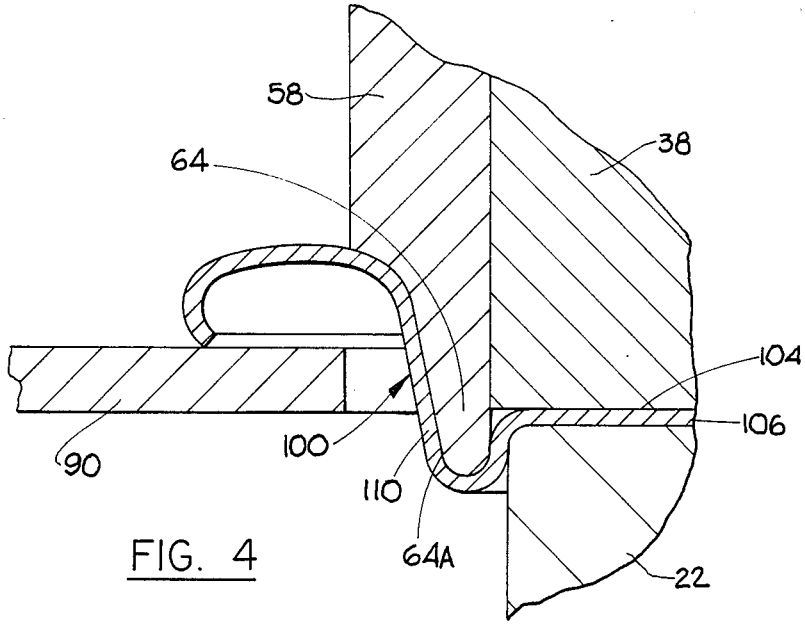
FIG. 4 is a partial, detailed, sectional view of the tooling assembly of the present invention illustrating completion of the bending of the pressure resistant end shell.

As illustrated best in FIG. 4, the annular nose 64 of reform ring 58 engages the exterior surface of the frustoconical wall portion 110 of the end shell 100. The outer surface 64A of nose 64 is configured to reform wall portion 110 into its final form. As the upper tooling assembly 14 continues to travel downwardly, the reform ring 58 is forced upwardly against springs 60 and support 30. Pressure pad 38 engages the exterior surface 104 of the central wall portion 106. The pressure pad 38 is biased downwardly by the force of spring 36 as transmitted through plate 48, pins 50 and post 40.

As the upper tool assembly 14 reaches the bottom of the downstroke (see FIG. 3), the bubble punch 26 and bubble die 44 form a bubble 70 near the center of the central wall portion 106. It is understood that the present reforming apparatus 10 is operational without the bubble die 44 and bubble punch 26.

At the bottom of the downstroke of the upper tool assembly 14, the central wall portion 106 is supported on its exterior surface 104 by the pressure pad 38 and supported on its interior surface 102 by the reform punch 22. Since the central wall portion 106 is captured between the pressure pad 38 and reform punch 22, the radii of central wall portion 106 and, an annular groove 122 (described below) can be maintained. Furthermore, the angularity of the frustoconical wall portion 110 is maintained by the annular nose 64.

Figure 5:
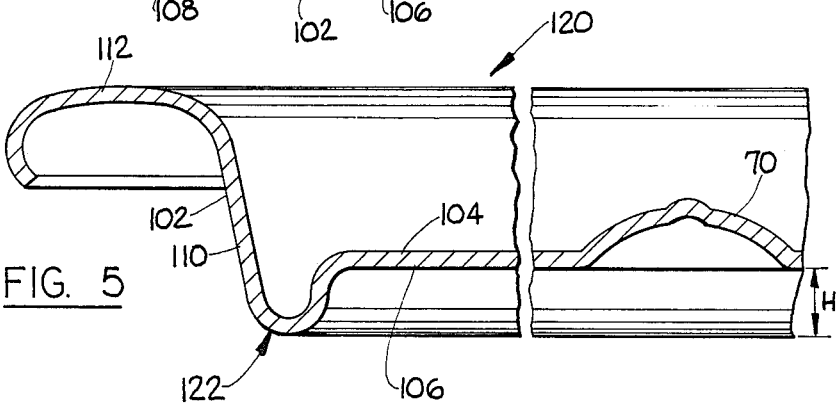
FIG. 5 is a partial, enlarged sectional view of an end shell reformed by the present invention.

An end shell 120 reformed by the present apparatus 10 is partially illustrated in FIG. 5. The end shell 120 includes a reinforcing channel, or annular groove, 122 that was formed when the lower and upper tool assemblies 112 and 114, respectively, were pressed against end shell 100. In comparison to the end shell 100 shown in FIG. 1, the central wall portion 106 of end shell 120 is raised toward the peripheral flange 112 and an annular groove 122 is formed around the raised central wall portion 106. The annular groove 122 is bounded on the outside by the frustoconical wall portion 110 and is bounded on the inside by an inner wall 124. In a preferred embodiment, central wall portion 106 is raised toward the peripheral flange 112 such that it is disposed at a height H of from 0.070 to 0.090 inches above the bottom of the annular groove 122. By increasing this height H, the pressure resistance of the end shell 120 is increased. A bubble 70 is formed in the central wall portion 106 as the upper tool assembly 14 reaches the bottom of its downstroke.

Although the present invention has been described with reference to preferred embodiments, workers skilled in the art will recognize that changes may be made in form and detail without departing from the spirit and scope of the invention.

What is claimed is:

1. An apparatus for reforming an end shell having a frustoconical wall portion disposed around a central wall portion, the frustoconical wall portion projecting upwardly and outwardly with respect to an exterior surface of the central wall portion, the apparatus comprising:

(a) a stationary tooling assembly including a reform punch for engaging an interior surface of said central wall portion of said end shell;

(b) a reciprocating tooling assembly including a spring loaded pressure pad complimentary to said reform punch for engaging said exterior surface of said central wall portion of said end shell;

(c) a transfer belt for transporting said end shell to and from said tooling assemblies, said transfer belt having at least one opening configured to transport said end shell; and (d) means for forming an annular groove around said central wall portion while said frustoconical wall portion is supported only on said exterior surface thereof, said pressure pad and said reform punch simultaneously engage and support said exterior and interior surfaces, respectively, of said central wall portion and said end shell aligned with said opening of said transfer belt, said forming means including a reform ring mounted circumferentially about and axially movable with respect to said pressure pad, said reform ring including an annular nose configured to form said annular groove while fully engaging and supporting said exterior surface of said frustoconical wall portion.

* * * * *